US005170731A

United States Patent [19]

Walker

[11] Patent Number: 5,170,731

[45] Date of Patent: Dec. 15, 1992

[54] ADJUSTABLE NEEDLE-CRAFT IMPLEMENTS

[76] Inventor: George E. Walker, 10 Pinelands Ave., Stoney Creek, Ontario, Canada, L8E 3A5

[21] Appl. No.: 779,469

[22] Filed: Oct. 18, 1991

[51] Int. Cl.[5] ..... D05C 15/06

[52] U.S. Cl. ..... 112/80.05

[58] Field of Search ..... 112/80.03, 80.04, 80.05, 112/80.06, 169, 80.16, 222; 223/102, 104; 66/117, 118, 115, 116

[56] References Cited

U.S. PATENT DOCUMENTS

| | | | |
|---|---|---|---|
| 512,911 | 1/1894 | Shogren | 112/80.03 X |
| 662,748 | 11/1900 | Wood | 112/80.03 X |
| 743,335 | 11/1903 | Rogers | 112/80.03 X |
| 1,357,687 | 11/1920 | Butler | 112/80.05 |
| 1,392,542 | 10/1921 | Vorce | 112/80.05 |
| 1,398,004 | 11/1921 | Cluff | 112/80.05 |
| 1,878,889 | 9/1932 | Roberts | 112/80.05 |
| 4,107,953 | 8/1978 | Casillo | 112/80.03 X |
| 4,306,510 | 12/1981 | O'Brien | 112/80.05 |
| 4,479,445 | 10/1984 | Walker | 112/80.05 |
| 5,109,780 | 5/1992 | Slouf et al. | 112/80.03 |
| 5,117,772 | 6/1992 | Hoctor et al. | 112/80.05 |

*Primary Examiner*—Werner H. Schroeder
*Assistant Examiner*—Paul C. Lewis
*Attorney, Agent, or Firm*—Patrick J. Hofbauer

[57] ABSTRACT

An adjustable needle-craft implement comprises an elongated graspable barrel having a longitudinally extending bore communicating between opposed ends of the barrel. The barrel includes a longitudinally extending plurality of mutually spaced apart transverse slots communicating with said bore's interior and form a barrel indexing rack. An elongated hollow cylinder supports a hollow tubular needle at one end thereof. The cylinder has a resiliently mounted cylinder indexing rack with transversely extending processes thereof that are adapted to be engagable in selective axial register with corresponding ones of the transverse slots in the barrel indexing rack. The cylinder is adapted to be received internally of the bore, in releasably lockable, longitudinally slidable relation therewith. The cylinder indexing rack is normally biased into releasable, selectively adjustable, mutually interfering axial register with an adjacently aligned portion of the barrel rack to thereby secure the cylinder and the barrel in mutually interlocked relation. The cylinder indexing rack is selectively operable against the bias, to disengage the interengaged cylinder and barrel racks to thereby enable selective longitudinal sliding adjustment of the mutually relative positioning of the cylinder and the barrel. In this way, the implement is adapted to adjustably position ones of selected portions of the needle's length beyond an adjacent end of the barrel, corresponding to selected ones of a predetermined plurality of relative positions of the barrel and the cylinder.

9 Claims, 3 Drawing Sheets

ADJUSTABLE NEEDLE-CRAFT IMPLEMENTS

FIELD OF THE INVENTION

This invention relates to needle-craft implements, and especially to ones suited for use in rug hooking or embroidery work or the like, for forming loops in yarns or threads that are decoratively secured to a web of supporting fabric.

BACKGROUND OF THE INVENTION

Implements of this general type typically include a handle with a needle along which yarn or thread can be extended. The needle is pointed at one end to facilitate its passage through the web of fabric that forms the rug backing, or embroidery foundation, etc, as the case may be. The purpose of these implements is to thereby facilitate the formation of yarn or thread loops that are then used in ways peculiar to the particular form of needle-craft under consideration.

In the case of an exemplary embroidery tool, such an implement might have a tubular needle mounted in outwardly extending relation from the end of a graspable handle. The handle is hollow and communicates interiorly with the hollow tubular needle, so as to accommodate the passage of thread from an opening in the opposite end of the handle, through the interior thereof, and into the interior of the tubular needle. A lateral opening or "eye" extending through the tubular wall of the needle, proximal to the end thereof that is furthest removed from the handle, is adapted to pass the thread from the interior of the needle, to the exterior thereof.

In any case, it will be appreciated that the size of the loop formed upon each passage of the needle through the web of fabric, will be determined by the distance beyond the opposed web surface that the needle extends. From the aesthetic point of view, uniformity of loop size is highly desirable. To this end, a number of attempts have been made to adjustably limit the extent to which the needle is free to penetrate the web. In one approach, small sleeves are provided with the implement. These sleeves are adapted to fit in secure frictional engagement over the outside of the tubular needle, and to abut against the fabric web once the needle has advanced to the limit of its intended penetration through the web. The sleeves are available in a variety of different lengths, to provide the user with an option in selecting various, corresponding loop sizes. For a number of reasons, this arrangement is not desirable. Firstly, the sleeves are separate pieces that can be easily lost, or at least frustratingly misplaced. Secondly, fitting the sleeve over the tube requires manual dexterity and close attention, if one is to avoid undesired contact with the pointed end of the needle.

Accordingly, a number of adjustment mechanisms have been developed in which provision has sought to have been made for adjustably locating the needle along the axis of the holder. This is done so that the holder in effect provides an adjustable means for abutting against the fabric web. In this way there is provided a selectively consistent, passive limit on the distance the needle travels through the web on each stroke. An example of one such device is set out in U.S. Pat. No. 4,479,445, while another is disclosed in U.S. Pat. No. 4,306,510.

One objection to such prior art devices is that they can, over time, become easily maladjusted in the course of normal use. Moreover, their infinite variability of positioning is neither necessary for the purposes of needle-craft nor, from the point of view of the user wishing to duplicate a previous adjustment setting, even desirable. In addition, the required rotational adjustment is both tedious, and in some cases may even be positively irritating to sufferers of such debilitating conditions as arthritis or carpal tunnel syndrome. This short-coming is especially pronounced when the needle must be withdrawn and re-extended for and following use, (as is done in the interests of safety and for the protection of the needle from physical damage when not in use). Finally, the indexing marking can also be very demanding on a user's visual acuity.

There remains a need in the art, therefore, for an adjustable needle-craft implement which facilitates easily reproducible adjustment settings, that can be accomplished without taxing the physical or visual abilities of expected users, while at the same time positively locking the needle at the desired setting so that any need for repeated readjustment during normal use, is substantially reduced. Moreover, it is highly desirable from a safety point of view that the needle be amenable to ready and convenient retraction/extension relative to the barrel of the implement, in order to encourage users to handle and store their implements safely.

SUMMARY OF THE INVENTION

In accordance with the present invention, therefore, there is provided an adjustable needle-craft implement which comprises an elongated graspable barrel having a longitudinally extending bore communicating between opposed ends thereof. The barrel includes a longitudinally extending plurality of mutually spaced apart transverse slots communicating with the bore's interior and thereby forming a barrel indexing rack.

The implement also includes an elongated hollow cylinder supporting a hollow tubular needle at one end thereof. The cylinder has a resiliently mounted cylinder indexing rack with transversely extending processes adapted to be engagable in selective axial register with corresponding ones of the transverse slots in the barrel indexing rack.

The cylinder is adapted to be received internally of the bore, in releasably lockable, longitudinally slidable relation therewith. With the cylinder positioned within the bore, the cylinder indexing rack is normally biased into releasable, selectively adjustable, mutually interfering axial register with an adjacently aligned portion of said barrel rack to thereby secure the cylinder and the barrel in mutually interlocked relation. The cylinder is, however, selectively operable against that bias, to disengage the inter-engaged cylinder and barrel racks to thereby enable selective longitudinal sliding adjustment of the mutually relative positioning of the cylinder and the barrel.

In accordance with the forgoing, the implement is adapted to adjustably position ones of selected portions of the needle's length beyond an adjacent end of the barrel, corresponding to selected ones of a predetermined plurality of relative positions of the barrel and the cylinder.

In a preferred form, the elongated hollow cylinder has a resilient lever member attached thereto in elastically deformable relation. The lever has the cylinder indexing rack arranged thereon in spaced apart relation from the lever's attachment to the cylinder. The lever normally resiliently biases the cylinder rack into selectively adjustable axial register with the adjacently aligned portion of the barrel rack. In this way, the cylinder and the barrel are normally secured in mutually interlocked relation. The lever is, however, selectively operable to be elastically deformed against the bias, and to thereby disengage the inter-engaged cylinder and barrel racks to enable relative longitudinal adjustment of the mutually relative positioning of the barrel and cylinder, with collateral axial re-positioning of the needles extension relative to the end of the barrel through which it is extendable.

DETAILED DESCRIPTION OF A PREFERRED EMBODIMENT

Introduction to the Drawings

Figure 1:
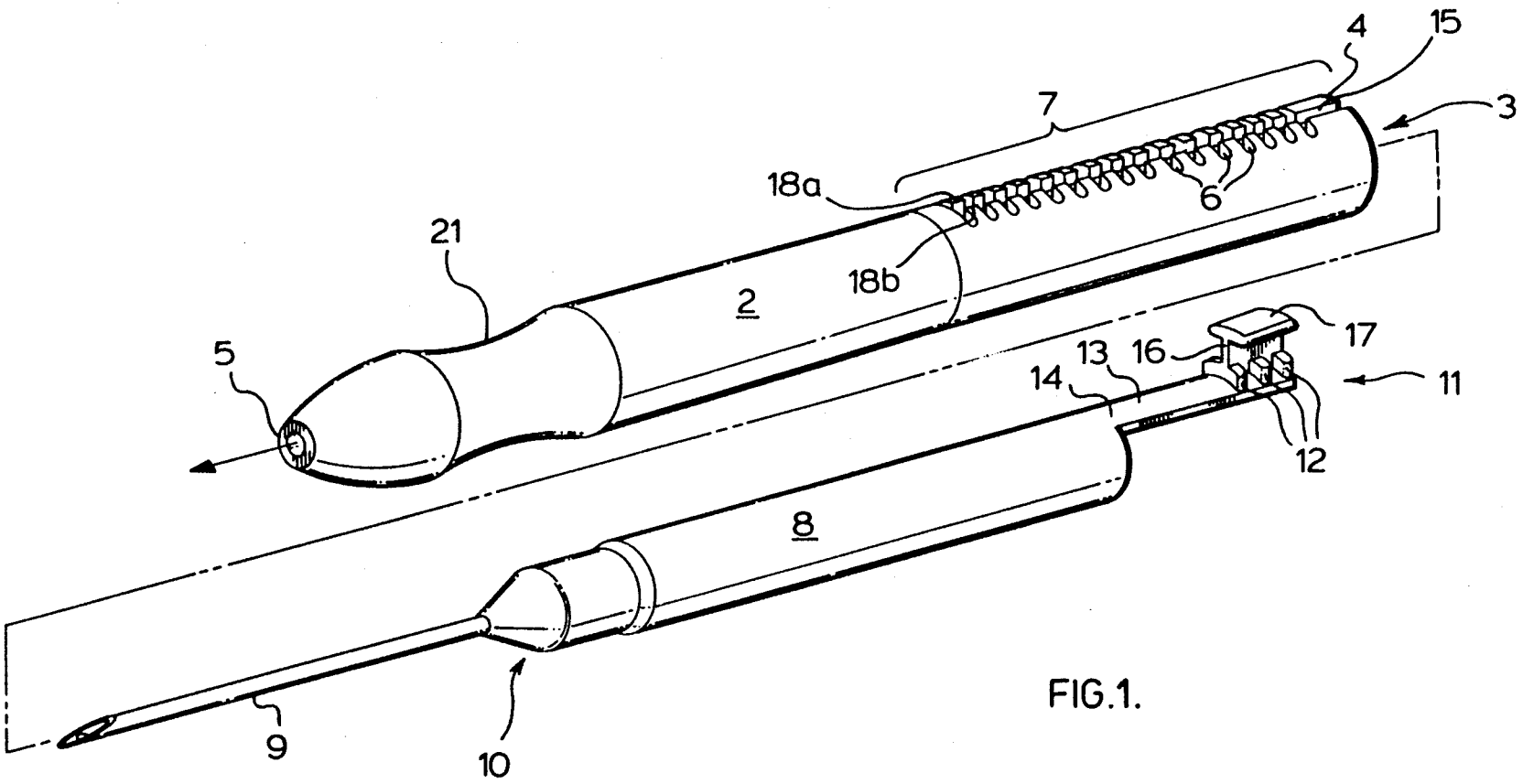
FIG. 1 is an exploded perspective view depicting the principal elements of a presently preferred embodiment of the present invention.

Referring now to FIG. 1 of the appended drawings, there is illustrated an adjustable needle-craft implement 1, comprising an elongated graspable barrel 2, having a longitudinally extending bore 3, communicating between opposed ends 4 and 5, of barrel 2. Barrel 2 includes a longitudinally extending plurality of mutually spaced apart transverse slots 6 communicating with the bore's interior and forming a barrel indexing rack, collectively indicated by reference numeral 7.

Elongated hollow cylinder 8, supports a hollow tubular needle 9, at one end 10, thereof. Cylinder 8, has a resiliently mounted cylinder indexing rack 11, with transversely extending processes 12, adapted to be engagable in selective axial register with corresponding ones of the transverse slots 6, in indexing rack 7 of barrel 2.

Cylinder 8 is adapted to be received internally of the bore 3, in releasably lockable, longitudinally slidable relation therewith. The cylinder indexing rack 11 is normally biased into releasable, selectively adjustable, mutually interfering axial register with an adjacently aligned portion of the barrel rack 7, to thereby secure cylinder 8 and barrel 2 in mutually interlocked relation. Cylinder 8 is selectively operable against the bias, to disengage the inter-engaged cylinder and barrel racks 11 and 7 respectively, to thereby enable selective longitudinal sliding adjustment in the mutually relative positioning of cylinder 8 and barrel 2.

This permits the adjustable positioning of ones of selected portions of needle 9 beyond an adjacent end 5 of the barrel 2, which portions correspond in length to selected ones of a predetermined plurality of relative positions of the barrel 2 and the cylinder 8.

More particularly, cylinder 8 has a resilient lever member attached thereto in elastically deformable relation, with the lever 13 having the cylinder indexing rack 11, arranged thereon in spaced apart relation from lever attachment 14. Lever 13 normally resiliently biases cylinder rack 11 into selectively adjustable axial register with an adjacently aligned portion of barrel rack 7, to thereby secure cylinder 8 in mutually interlocked relation relative to barrel 2. Lever 13 is selectively operable to be elastically deformed against the normal bias thereof, to thereby disengage the inter-engaged cylinder and barrel racks 11 and 7, and to enable relative longitudinal adjustment of their mutually relative positioning, with concomitant axial re-positioning of needle 9 relative to end 5.

In the preferred embodiment illustrated, barrel 2, includes a longitudinally extending elongated slot 15, formed in the side thereof and communicating laterally therethrouqh into the interior of the bore 3. Slot 15 extends from an opening in a barrel edge along the longitudinal limit of a first end 4, of the barrel 2, to a point intermediate between that first end 4 of barrel 2, and an opposed second end 5 thereof. The transverse slots 6, extend transversely to the elongated slot 15, and together therewith form the barrel indexing rack 7.

In addition, cylinder indexing rack 11, includes an exteriorly extending process 16 adapted to be received in slotted relation within elongated slot 15. Exteriorly extending process 16 terminates exteriorly of barrel 2, in an enlarged operating surface 17, adapted to two purposes. Firstly, surface 17 provides a depressible operating surface for manually applying elastically deforming force against lever is, to thereby selectively disengage inter-engaged cylinder and barrel racks 7 and 11. Secondly, surface 17 blockingly interferes with longitudinal slot defining edges **18*a* and 18*b* on barrel 2, to thereby prevent exteriorly extending process 16, from being depressed all the way through slot 15**.

Figures 2, 3:
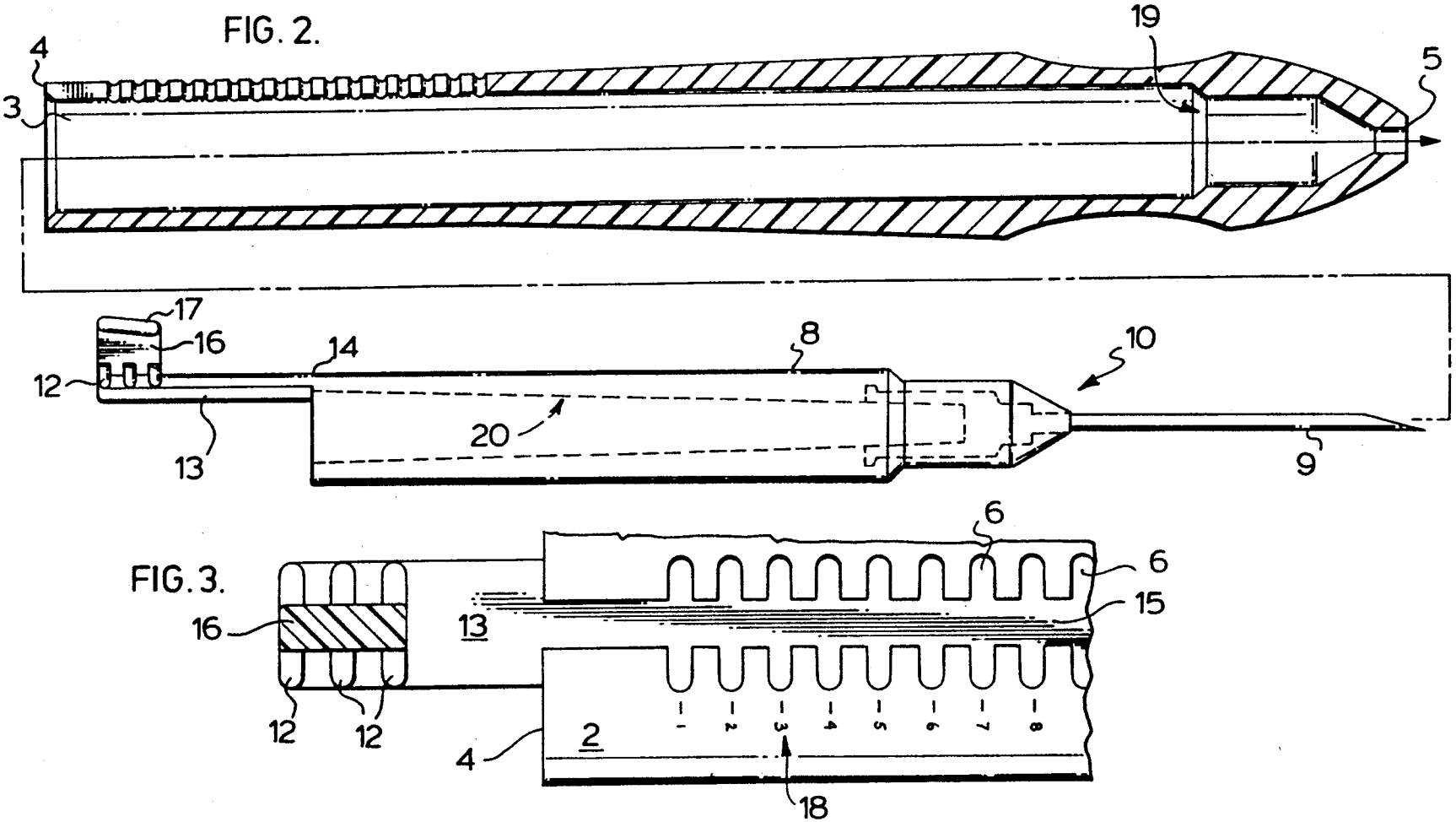
FIGS. 2 is an exploded cross-sectional view of the principle elements depicted in FIG. 1.
FIG. 3 is an enlarged view of the respective indexing rack portions of the principle elements of the embodiment shown in FIGS. 1 and 2.

Referring now in particular to FIG. 3 of the drawings, the exteriorly extending process 16 is shown to be adapted to align with positional indicia 18 marked on barrel 2, that uniquely identify corresponding ones of said plurality of relative positions of barrel 2 and cylinder 8, and are thereby indicative of the length of the needle 9 extending beyond end 5.

Figure 5:
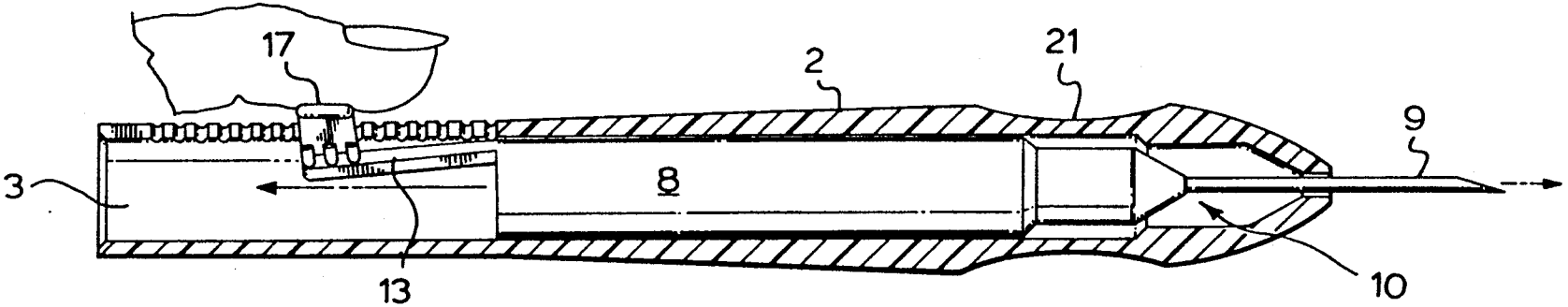
Figure 4:
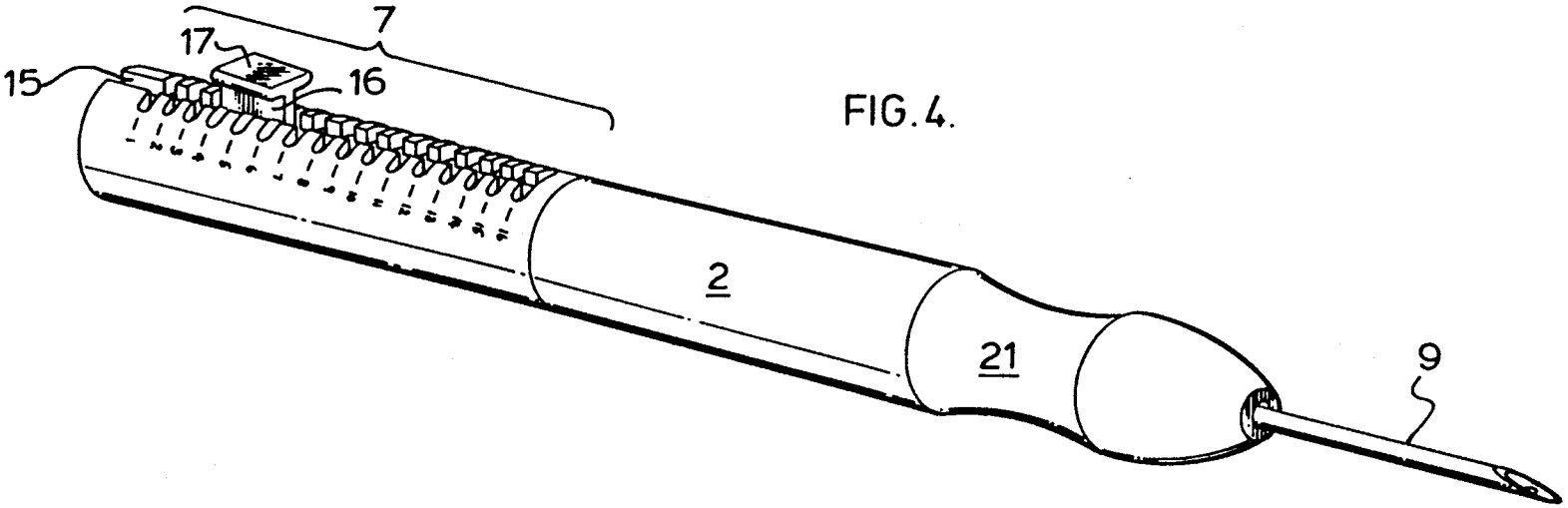
FIG. 4 is a perspective view of the fully assembled needle-craft implement shown in FIGS. 1, 2 and 3; and, FIG. 5 is an elevated side view, in cross-section, of the assembled implement shown in FIG. 4, illustrating the operation of the adjustably interlocking racks.

Referring now to FIGS. 2 and 5 it can be seen that the bore 3 extends from a first end 4 of barrel 2 towards an opposed second end 5 thereof, adjacent which depends an inward diametric extension 19 of the bores wall, Extension 19 is operable to interferingly limit axial travel of cylinder 8 in the direction of said second end 5.

Also shown in FIGS. 2 and 5 is the diametrically tapering interior wall 20 of cylinder 8.

As shown in FIGS. 1, 2, 4 and 5, the exterior surface 21 on barrel 2 is contoured to provide readily graspable surfaces.

In operation, an operator, acting on surface 17 in the manner illustrated in FIG. 5, depresses lever 13 sufficiently to overcome the normal resilient bias thereof, and deflects the lever sufficiently to disengage the interacting elements of respective racks 7 and 11. The operator then slides surface 17 forwardly or rearwardly along the length of slot 15, to correspondingly retract or extend needle 9 relative to barrel end 5. If desired, cylinder 8 can be readily withdrawn from within bore 3 by drawing surface 17 rearwardly, past the longitudinal limit of barrel 2, at end 4 thereof.

The present implement provides a positive locking system that affords users a readily visible and easily adjustable device. The indicia are always visible to the operator and adjustment does not require the rotational hand movements that are needed in many of the prior art devices. Moreover, where prior devices relied on cooperatively threaded surfaces for achieving adjustability, they needed to be fairly securely frictionally engaged, so that they would not back off during operation of the device. Unfortunately, this leads to both increased effort on the operator's part, in adjusting the device, and increased wear on the device, which in the long run can result in loss of the surface friction needed to reliably secure the adjustment surfaces to one another. This is not a problem which need arise in connection with above described device. Lastly, it is noted that the tapered interior of the cylinder is helpful in avoiding the device being abused by intravenous drug users, since the tapered interior walls do not readily accommodate a syringe plunger.

I claim:

1. An adjustable needle-craft implement comprising:

an elongated graspable barrel having a longitudinally extending bore communicating between opposed ends of said barrel, and including a longitudinally extending plurality of mutually spaced apart transverse slots communicating with said bore's interior and forming a barrel indexing rack;

an elongated hollow cylinder supporting a hollow tubular needle at one end thereof, said cylinder having a resiliently mounted cylinder indexing rack with transversely extending processes shaped and sized so as to be engagable in selective axial register with corresponding transverse slots in said barrel indexing rack;

wherein said cylinder is shaped and sized so as to be received internally of said bore, in releasably lockable, longitudinally slidable relation therewith, and wherein said cylinder rack is normally biased into releasable, selectively adjustable, mutually interfering axial register with an adjacently aligned portion of said barrel rack to thereby secure said cylinder and said barrel in mutually interlocked relation, said cylinder being selectively operable against said bias, to disengage the cylinder rack and the barrel rack so as to thereby enable selective longitudinal sliding adjustment of the mutually relative positioning of said cylinder and said barrel;

wherein said exteriorly extending process terminates exteriorly of said barrel, in an enlarged operating surface, shaped and sized so as to: provide a depressible operating surface for manually applying elastically deforming force against said lever, to thereby disengage the cylinder rack and the barrel rack; and whereby said implement is shaped and sized so as to adjustably position selected portions of said needle's length beyond an adjacent end of said barrel, said selected portions corresponding to relative positions of said barrel and said cylinder.

2. The adjustable needle-craft implement according to claim 1, wherein said elongated hollow cylinder has a resilient lever member attached thereto in elastically deformable relation, with said lever having said cylinder indexing rack arranged thereon in spaced apart relation from said levers attachment to said cylinder, and wherein said lever normally resiliently biases said cylinder rack into selectively adjustable axial register with said adjacently aligned portion of said barrel rack to thereby secure said cylinder in mutually interlocked relation, said lever being selectively operable to be elastically deformed against said bias, to thereby disengage the cylinder rack and the barrel so as to enable said selective longitudinal sliding adjustment of said mutually relative positioning of the cylinder and the barrel.

3. The adjustable needle-craft implement according to claim 2, wherein:

said barrel includes a longitudinally extending elongated slot formed in the side thereof and communicating laterally therethrough into the interior of the bore, and wherein said plurality of mutually spaced apart transverse slots extend transversely to said elongated slot, and together therewith form said barrel indexing rack; and, wherein said cylinder indexing rack includes transversely extending processes shaped and sized so as to be received in slotted relation with said elongated slot.

4. The adjustable needle-craft implement according to claim 3, wherein said exteriorly extending process is shaped and sized so as to align with positional indicia marked on said barrel that uniquely identify corresponding relative positions of said barrel and said cylinder.

5. The adjustable needle-craft implement according to claim 4, wherein said longitudinally extending elongated slot extends from an opening an a barrel edge along the longitudinal limit of a first end of the barrel, to a point intermediate between said first end of said barrel, and an opposed second end thereof.

6. The adjustable needle-craft implement according to claim 5, wherein said enlarged operating surface of said exteriorly extending process blockingly interferes with said longitudinally extending elongated slot defining edges on said barrel to thereby prevent said exteriorly extending process from being depressed all the way through said slot.

7. The adjustable needle-craft implement according to claim 6, wherein said bore extends from a first end of said barrel towards an opposed second end thereof, adjacent which depends an inward diametric extension of said bore's wall that is operable to interferingly limit axial travel of said cylinder in the direction of said second end.

8. The adjustable needle-craft implement according to claim 7, wherein said barrel's exterior is contoured to provide graspable surfaces.

9. The implement according to claim 1, wherein said cylinder has a diametrically tapering hollow interior.

* * * * *